US005653095A

United States Patent [19]

Stamm

[11] Patent Number: 5,653,095

[45] Date of Patent: Aug. 5, 1997

[54] TENSIONING AND SEALING APPARATUS FOR STRAPPING AN OBJECT WITH A PLASTIC BAND

[75] Inventor: Nikolaus Stamm, Thalwil, Switzerland

[73] Assignee: Orgapack AG, Dietikon, Switzerland

[21] Appl. No.: 357,227

[22] Filed: Dec. 12, 1994

[30] Foreign Application Priority Data

Jan. 24, 1994 [CH] Switzerland ..... 00200/94

[51] Int. Cl.[6] ..... B65B 67/08

[52] U.S. Cl. ..... 53/592; 53/582; 100/32; 100/33 PB; 156/494; 156/502

[58] Field of Search ..... 53/582, 590, 592; 100/32, 33 PB; 156/494, 502, 579

[56] References Cited

U.S. PATENT DOCUMENTS

| | | | |
|---|---|---|---|
| 3,586,572 | 6/1971 | Ericsson . | |
| 3,799,835 | 3/1974 | Gilmore . | |
| 3,944,460 | 3/1976 | Karr | 53/592 X |
| 4,272,314 | 6/1981 | Banai . | |
| 4,820,363 | 4/1989 | Fischer | 53/592 X |
| 5,117,615 | 6/1992 | Kung et al. | 53/592 X |

FOREIGN PATENT DOCUMENTS

| | | | |
|---|---|---|---|
| 2520349 | 5/1975 | Germany | 53/582 |
| 2701126 | 6/1978 | Germany . | |
| 3013429 | 7/1989 | Germany . | |
| 1562848 | 3/1980 | United Kingdom . | |

*Primary Examiner*—Linda Johnson
*Attorney, Agent, or Firm*—Spencer & Frank

[57] ABSTRACT

A tensioning and sealing apparatus for strapping an object (2) with a plastic band (1) includes a housing (3) having a tensioning unit (4) for retaining two ends (6, 7) of the plastic band (1) which are to be sealed and for tensioning the same and having a sealing unit (5) for connecting the two mutually overlapping ends (6, 7). The tensioning unit (4) has a tensioning shoe (10) and a toothed tensioning wheel (13) which is mounted on a pivotable rocker (11), which can be driven via a tensioning shaft (12), and which is intended for pressing the plastic band (1) against the tensioning shoe (10) and for gripping the same upon rotation. The bearing (15) of the pivotable rocker (11) is arranged on the side of the tensioning shoe (10) and behind the latter in the tensioning direction (14), the rocker axis being located between a bearing surface (16) of the tensioning shoe (10) and a base plate (8). The result is that the rocker (11), with the tensioning wheel (13), on the one hand exerts a sufficient press-on force on the plastic band (1) to be tensioned, and on the other hand can be raised again in any position of use of the apparatus without a great deal of force.

20 Claims, 8 Drawing Sheets

TENSIONING AND SEALING APPARATUS FOR STRAPPING AN OBJECT WITH A PLASTIC BAND

BACKGROUND OF THE INVENTION

The invention relates to a tensioning and sealing apparatus for strapping an object with a plastic band. More particularly, the invention is directed to a tensioning and sealing apparatus of the type that includes a housing having a tensioning unit for retaining two ends of a plastic band which are to be sealed and for tensioning the same, and having a sealing unit for connecting the two mutually overlapping ends, the tensioning unit exhibiting a tensioning shoe and a toothed tensioning wheel which is fastened on a pivotable rocker, which can be driven by a tensioning shaft, and which is intended for pressing the plastic band against the tensioning shoe and for gripping the same upon rotation.

Such an apparatus is known from the Patent Specification DE 30 13 429 C2. In this Specificaiton, the description is given of an appliance in which, after the introduction of the plastic band, with the aid of a rocking lever, a rocker, and thus a ttensioning wheel, is lowered onto the band. The tensioning wheel is then rotated by means of a rotor drive, as a result of which the band is tensioned.

The known apparatus has, inter alia, the disadvantage that the rocker, with the tensioning wheel, presses against the band and the tensioning shoe with a vastly increasing force as the band tension increases, this resulting in rapid wear of the tensioning shoe. Moreover, the tensioning unit has to be designed in a correspondingly stable, and thus heavy, manner. Furthermore, the rocker, with the tensioning wheel, is clamped fast during the tensioning process by the progressive press-on force between its bearing and the tensioning shoe, with the result that it is very difficult to release the band tensioning again without severing the band. Plastic band thus goes to waste if, for any reason, the tensioning process is not carried out satisfactorily.

SUMMARY OF THE INVENTION

The object of the invention is to provide a tensioning and sealing apparatus of the generic type, in the case of which the rocker, with the tensioning wheel, on the one hand exerts a sufficient press-on force on the band to be tensioned and, on the other hand, can be raised again in any position of use of the apparatus without a great deal of force.

Said object is achieved according to the invention in that the bearing of the pivotable rocker is arranged on the side of the tensioning shoe and behind the latter in the tensioning direction, the rocker axis being located between a bearing surface of the tensioning shoe and a baseplate. A sufficient press-on force of the tensioning wheel on the plastic band to be tensioned is thus ensured without the releasing of the band tensioning being rendered more difficult.

BRIEF DESCRIPTION OF THE DRAWINGS

An exemplary embodiment of the invention is explained in more detail hereinbelow with reference to the drawings, in which.

DESCRIPTION OF THE PREFERRED EMBODIMENT

Figure 1:
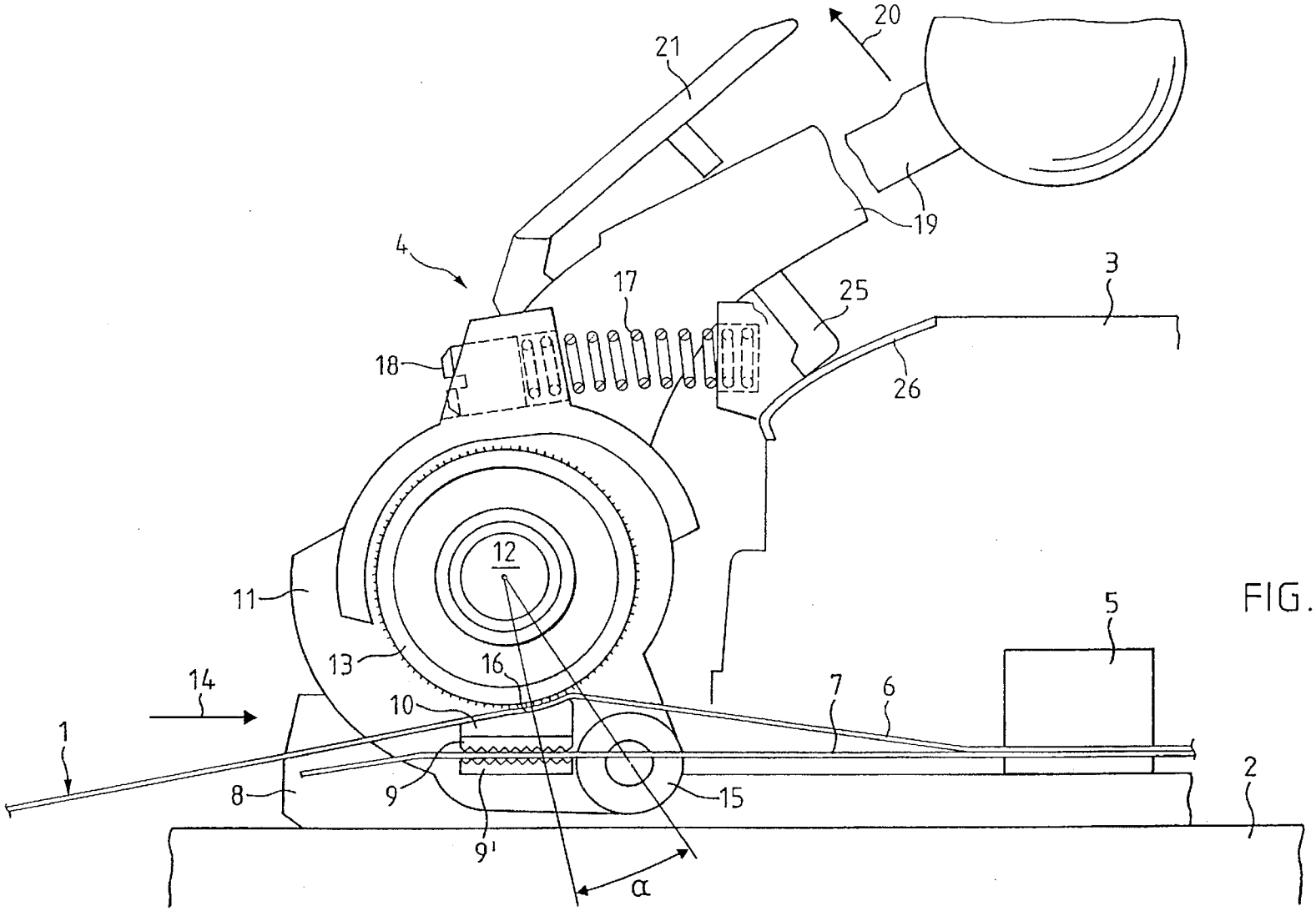
FIG. 1 shows a side view of the apparatus according to the invention.

In FIG. 1, the tensioning and sealing apparatus is represented schematically in a side view. It is positioned on an object 2, to be strapped with a thermoplastic band 1, and comprises a housing 3 having a tension unit 4 and a sealing unit 5. The plastic band 1 is laid around the object 2, and two of its ends 6, 7 which are to be sealed are retained by the tensioning unit 4. For this purpose, the sealing unit 5 is suitable for connecting the two mutually overlapping ends 6, 7 in a manner known per se, for example by friction welding, after the plastic band 1 has been tensioned.

If the plastic band 1 is unwound from a supply roller, a separating device (not shown) can be arranged downstream of the tensioning unit 4 for the purpose of separating off the required plastic-band portion from the supply roller.

The housing 3 exhibits a baseplate 8 on which the tensioning unit 4 and the sealing unit 5 are fastened.

The tensioning unit 4 exhibits two toothed plates 9, 9' for retaining the lower end 7 to be sealed of the plastic band 1. Fastened on the upper toothed plate 9 is a tensioning shoe 10 for receiving the upper end 6 to be sealed of the plastic band 1. Further provided is a pivotable rocker 11, with a toothed tensioning wheel 13 which can be driven via a tensioning shaft 12 and is intended for pressing the upper end 6 of the plastic band 1 against the tensioning shoe 10 and for gripping the upper end 6 upon rotation of the tensioning shaft 12, with the result that the plastic band 1 can be tensioned in the tensioning direction 14 in a manner known per se, as is explained in the following.

The bearing 15 of the pivotable rocker 11 is arranged on the side of the tensioning shoe 10 (here: beneath the upper end 6 of the plastic band 1) and behind the latter in the tensioning direction 14, the rocker axis being located between a bearing surface 16 of the tensioning shoe 10 and the baseplate 8. Consequently, the rocker 11, with the tensioning wheel 13, on the one hand exerts a sufficient press-on force on the band 1 to be tensioned and, on the other hand, it can be raised again in any position of use of the apparatus without a great deal of force. The tensioning shoe 10 and the upper toothed plate 9 are, as is explained in the following, arranged loosely between the tensioning shaft 12 and the lower toothed plate 9'.

The rocker 11 can be pivoted essentially between three positions. When it is pivoted fully to the right (shown in FIG. 2, the so-called basic position), the tensioning shoe 10 and the upper toothed plate 9 can be raised from the lower toothed plate 9', with the result that the lower end 7 to be sealed of the plastic band 1 can be introduced between the toothed plates 9, 9'. In a central position (shown in FIG. 3, the so-called non-engaged position), the toothed plates 9, 9' clamp in the lower end 7, and the tensioning wheel 13 is held at a distance from the clamping shoe 10, with the result that the upper end 6 to be sealed of the plastic band 1 can be introduced between the tensioning shoe 10 and the tension wheel 13. When the rocker 11 is pivoted fully to the left (shown in FIG. 1 and FIG. 5, the so-called tensioning position), the tensioning wheel 13 is pressed against the clamping shoe 10 and clamps in the upper end 6, with the result that the tensioning process can be carried out by actuating the tensioning shaft 12. How this happens and how the rocker 11 can be pivoted between these three positions is explained in the following with reference to FIGS. 2 to 9.

Figure 5:
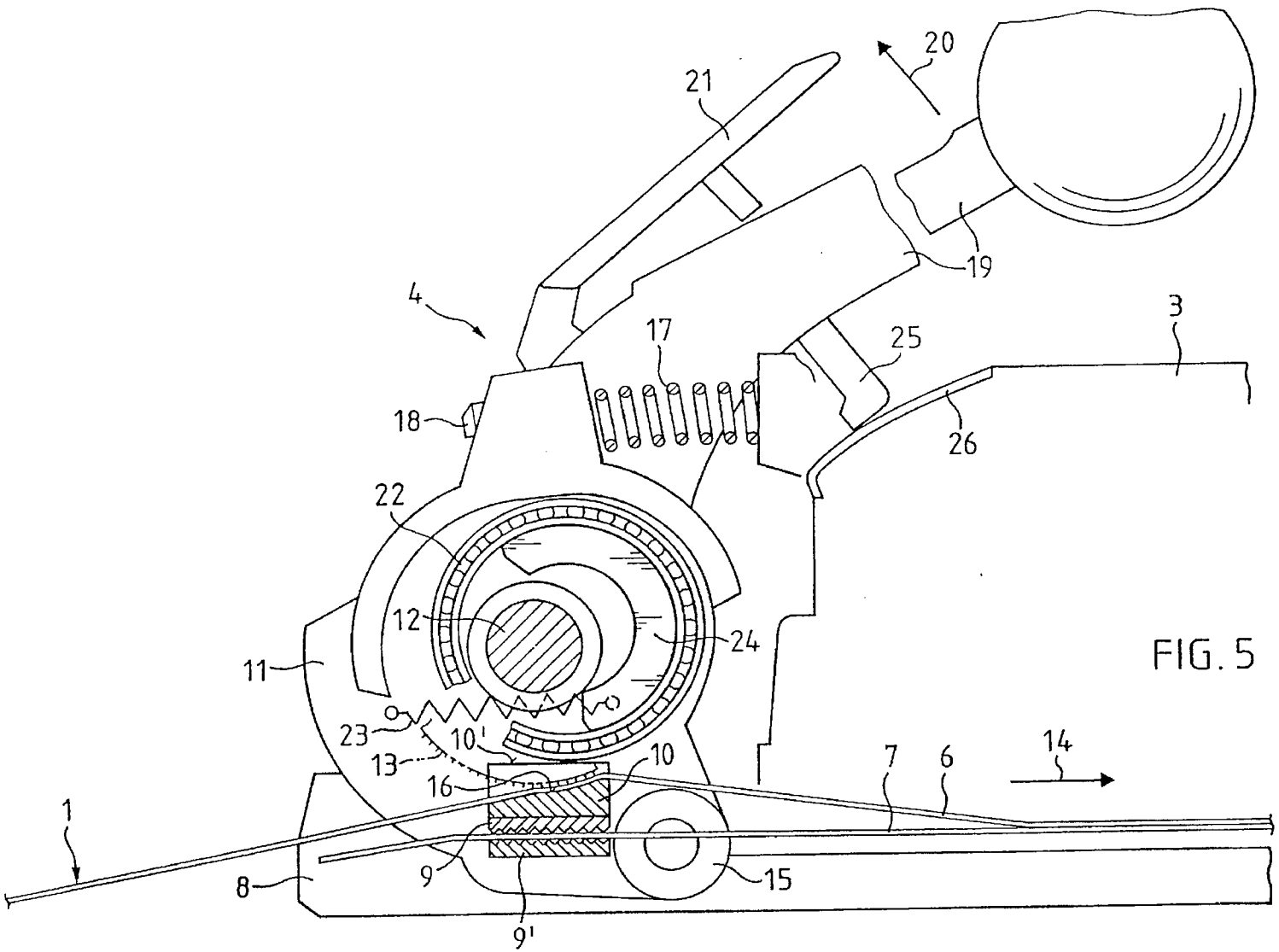
FIG. 5 shows a section through the apparatus in a tensioning position.

The tensioning shoe 10 exhibits a bearing surface 16 which is at least partly designed as a cylindrical depression and is intended for receiving the upper end 6 of the plastic band 1 in the non-engaged position (FIG. 3) and for supporting the tensioning wheel 13 in the tensioning position (FIG. 5). Furthermore, the tensioning shoe 10 exhibits a supporting surface 10' for supporting (via further parts) the tensioning shaft 12 in the non-engaged position. The angle $\alpha$, in the plane perpendicular to the tensioning-shaft axis, between the semiaxis from the tensioning-wheel centre to the bearing of the rocker 11, on the one hand, and the semiaxis from the tension-wheel centre to the centre of the bearing surface 16 designed as a cylindrical depression, on the other hand, is between 20° and 30° when the tensioning wheel 13 bears on the tensioning shoe 10. It has been shown that such an angle $\alpha$ is optimum for the tensioning unit 4.

The rocker 11 is connected, via a compression spring 17 with adjustable spring force, to the housing 3, with the result that, when the tension wheel 13 bears on the tensioning shoe 10, the press-on force of the tensioning wheel 13 on the plastic band 1 on the tensioning shoe 10 can be regulated. The adjustment of the spring force is carried out by means of an adjustment screw 18 on the rocker 11.

A tensioning lever 19 is mounted on the tensioning shaft 12 in order to tension the plastic band 1 when the tensioning wheel 13 bears on the tensioning shoe 10. In the case of a pivoting movement of the tensioning lever 19 in the direction 20, the tensioning wheel 13, likewise mounted on the tensioning shaft 12, is carried along, in a manner known per se, by means of a ratchet wheel 27, arranged on the tensioning shaft 12 and not shown in FIG. 1 (FIGS. 2, 4, 6, 7, 8, 9) with the result that it is rotated in the anticlockwise direction and tensions the plastic band 1 in the tensioning direction 14. By means of a sealing button 21, the sealing unit 5 is activated in order to carry out friction welding of the ends 6, 7 of the tensioned plastic band 1.

The tensioning unit 4 exhibits a locking detent 25 for arresting the rocker 11 in the tensioning position (FIG. 5). This locking detent 25 is arranged on the tensioning lever 19, and the housing 3 exhibits a stop 26 for the detent 25. Said detent serves to restrict the displacement of the tensioning lever 19 during the tensioning process. If the tensioning lever 19, during tensioning of the plastic band 1, were to be pivoted too far downwards, the rocker 11 would, in fact, be moved back out of its tension position into the non-engaged position, and this would result in the undesired release of the plastic band 1. The locking detent 25 thus ensures that, during the tensioning process, the full displacement of the tensioning lever 19 can be utilized without undesired release of the tensioning wheel 13. Its precise effect is explained in more detail with reference to FIGS. 7 and 8.

Since the sealing unit 5 is arranged behind the tensioning wheel 13, as seen in the tensioning direction, the end 6 near the sealing unit 5 is not tensioned. This is advantageous during friction welding of the mutually overlapping ends 6, 7 of the plastic band 1 since a non-tensioned band portion is easier to set in vibration than a tensioned band portion.

Of course, the tensioning shaft 12 may also be motor-driven. In this case, the tensioning lever 19 is rendered superfluous.

Figure 2:
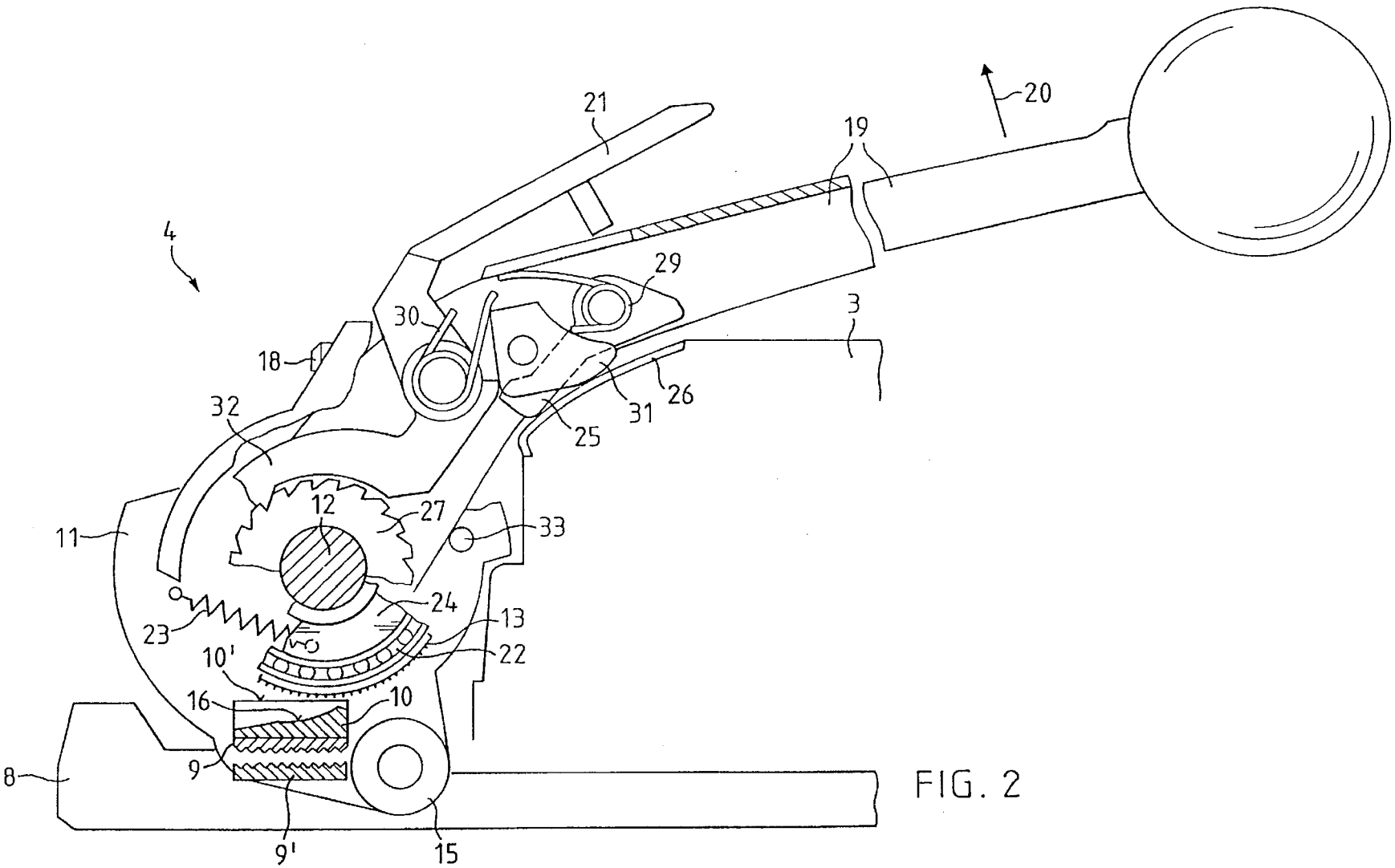
FIG. 2 shows a section through the apparatus in a basic position.
Figure 7:
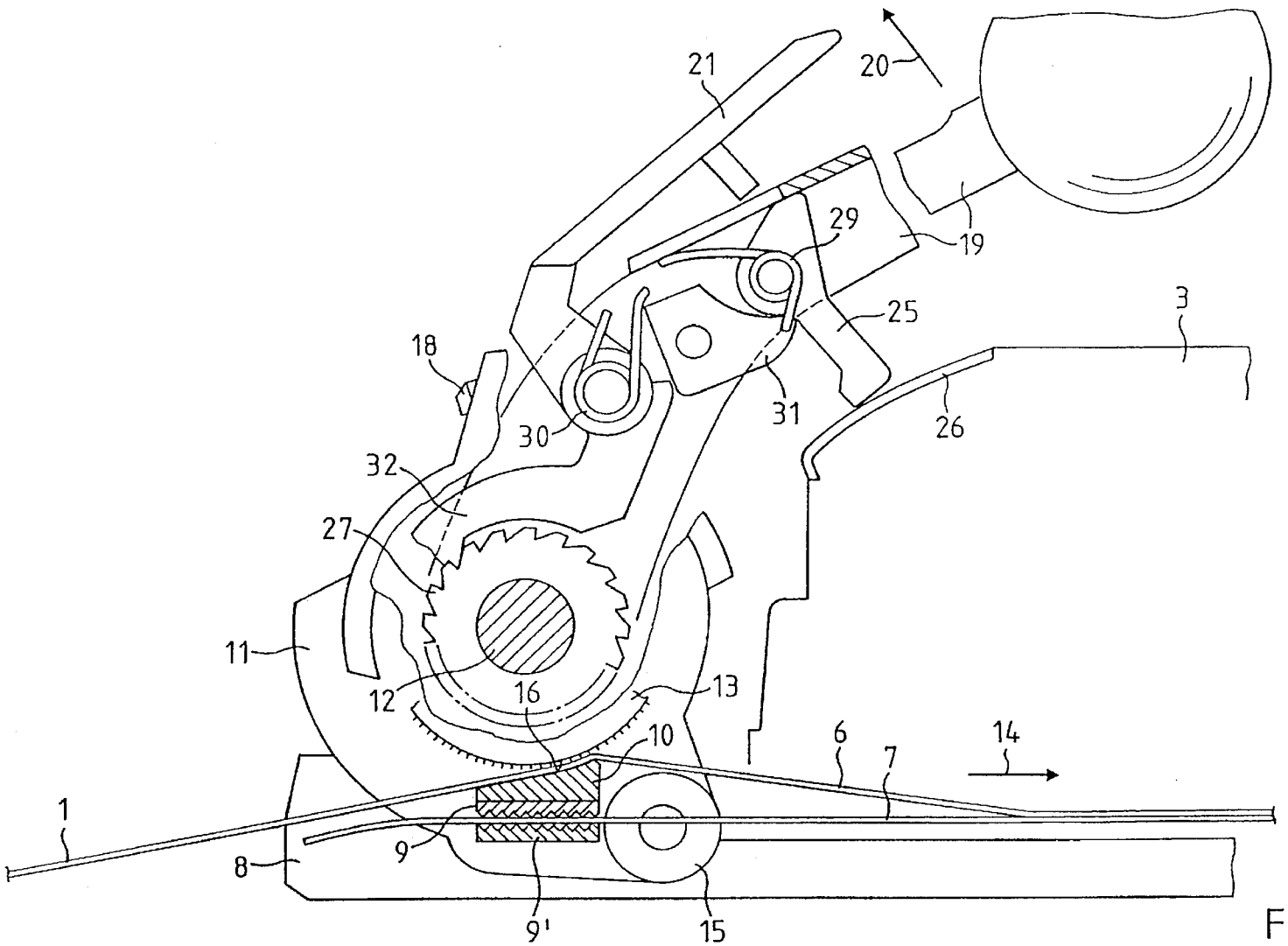
FIG. 7 shows a section through the apparatus according to the invention, with a sealing button in a first position.
Figure 8:
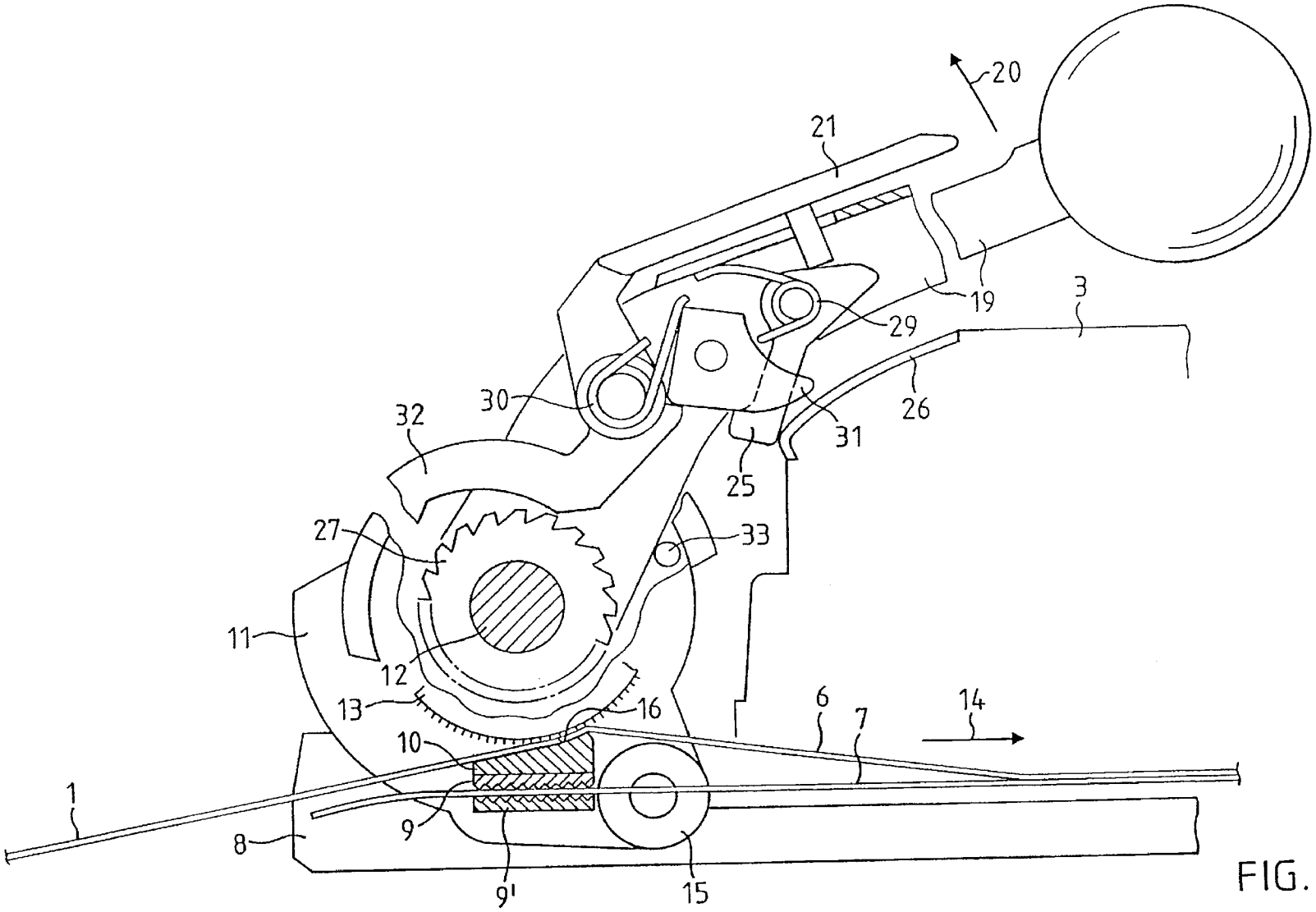
FIG. 8 shows a section through the apparatus of FIG. 7, with the sealing button in a second position.

FIG. 2 shows a section through the apparatus in a basic position. The tensioning shoe 10, with the bearing surface 16 and the supporting surface 10', and the upper toothed plate 9 connected to the tensioning shoe 10, are produced from a lightweight material and are arranged loosely on the base-plate 8 via vertical guide pins (not shown), with the result that, in the basic position, they can be raised from the lower toothed plate 9' in a simple manner. The tensioning lever 19 is pressed fully downwards, with the result that the locking detent 25, of which the effect is explained in more detail with reference to FIGS. 7 and 8, is pressed against the stop 26. The rocker 11 exhibits a stop pin 33 for the tensioning lever 19, with the result that, by the movement of the tensioning lever 19, the rocker 11 is carried along about its bearing 15 in the clockwise direction, counter to the force of the compression spring 17, to such an extent that the tensioning shoe 10 and the upper toothed plate 9 can be raised from the lower toothed plate 9': the supporting surface 10' is not subjected to loading. The tensioning lever 19 is held manually in this basic position since the compression spring 17 presses constantly against the rocker in the anticlockwise direction.

Behind the tensioning wheel 13, opposite the supporting surface 10' of the tensioning shoe 10, a ball bearing 22 is fitted loosely, (such that it can be displaced perpendicularly with respect to the tensioning-shaft axis) about the tension shaft 12. Located between the ball bearing 22 and the tensioning shaft 12 is a rotatable ring element 24, which is connected to the rocker 11 via a tension spring 23 and serves as a wedge. The effect of these parts is described with reference to FIGS. 3, 4, 5 and 6. A ratchet wheel 27 is likewise mounted on the tension shaft 12 and serves to tension the plastic band 1 in the tensioning position (FIG. 5). The mounting of the individual parts on the tension shaft 12 is explained in more detail with reference to FIGS. 4 and 6.

A torsion spring 29 is provided on the locking detent 25. The sealing button 21 exhibits a torsion spring 30. A further detent 31 is arranged between the sealing button 21 and the locking detent 25. A tensioning detent 32 fastened on the sealing button 21 engages in the ratchet wheel 27, and a back stop 40 which is not shown here (see FIGS. 4 and 6) ensures that the tensioning shaft 12, with the tensioning wheel 13, can be rotated only in the tensioning direction 14. As has been said, the precise effect is explained in more detail with reference to FIGS. 7 and 8.

In the basic position according to FIG. 2, the lower end 7 to be sealed of the plastic band 1 can be introduced between the toothed plates 9, 9' or removed therefrom again.

Figure 3:
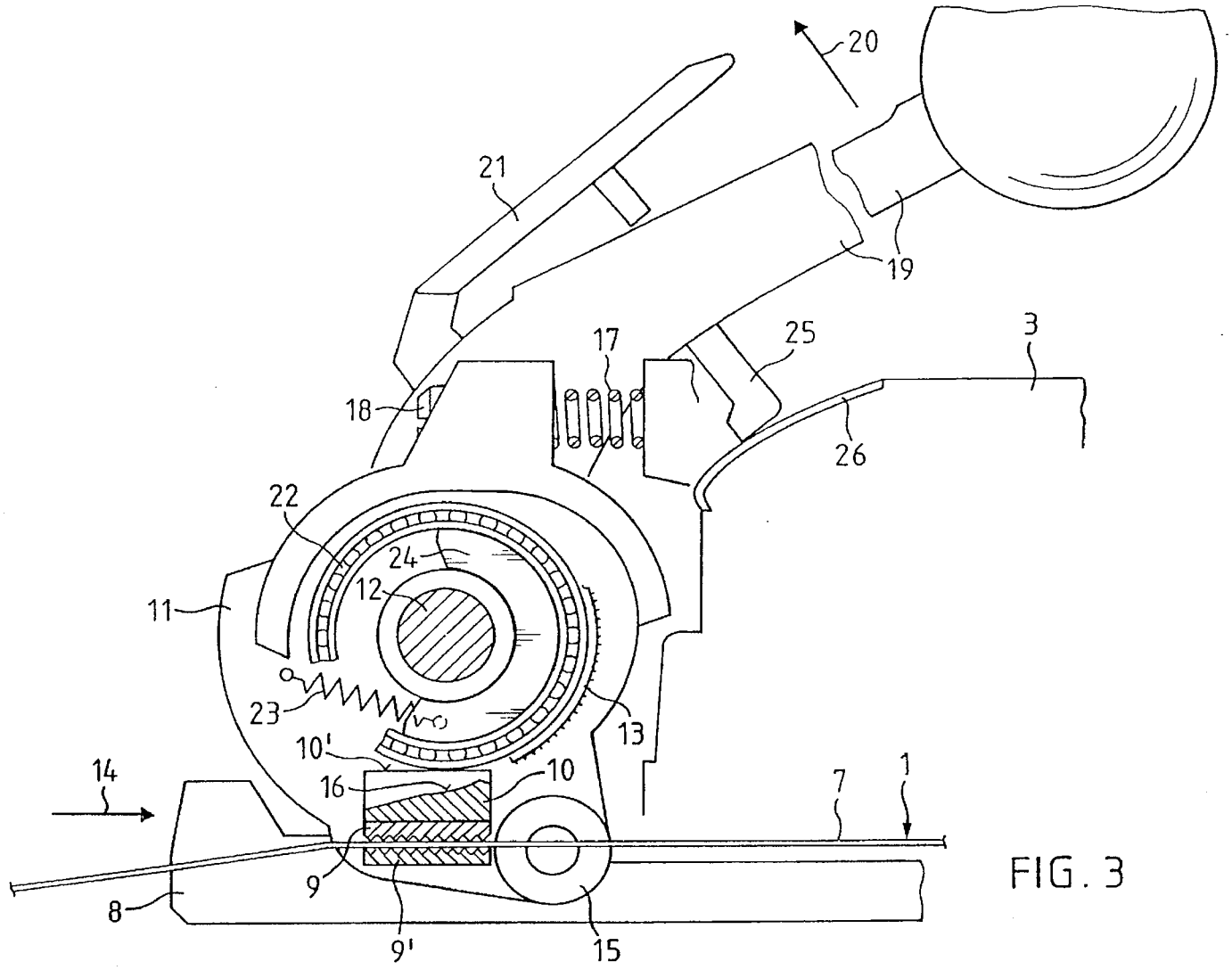
FIG. 3 shows a section through the apparatus in a non-engaged position.

FIG. 3 shows a section through the apparatus according to the invention in the non-engaged position. Starting from the basic position according to FIG. 2, this position is reached automatically owing to the pressure of the compression spring 17 when the tensioning lever 19 is no longer pressed downwards. The compression spring 17 presses the rocker 11 so far in the anticlockwise direction until the tensioning shaft 12, via the ring element 24 and the ball bearing 22, bears on the supporting surface 10' of the tensioning shoe 10 (see also FIG. 4). The lower band end 7 is thus clamped fixedly between the toothed plates 9, 9'.

Figure 4:
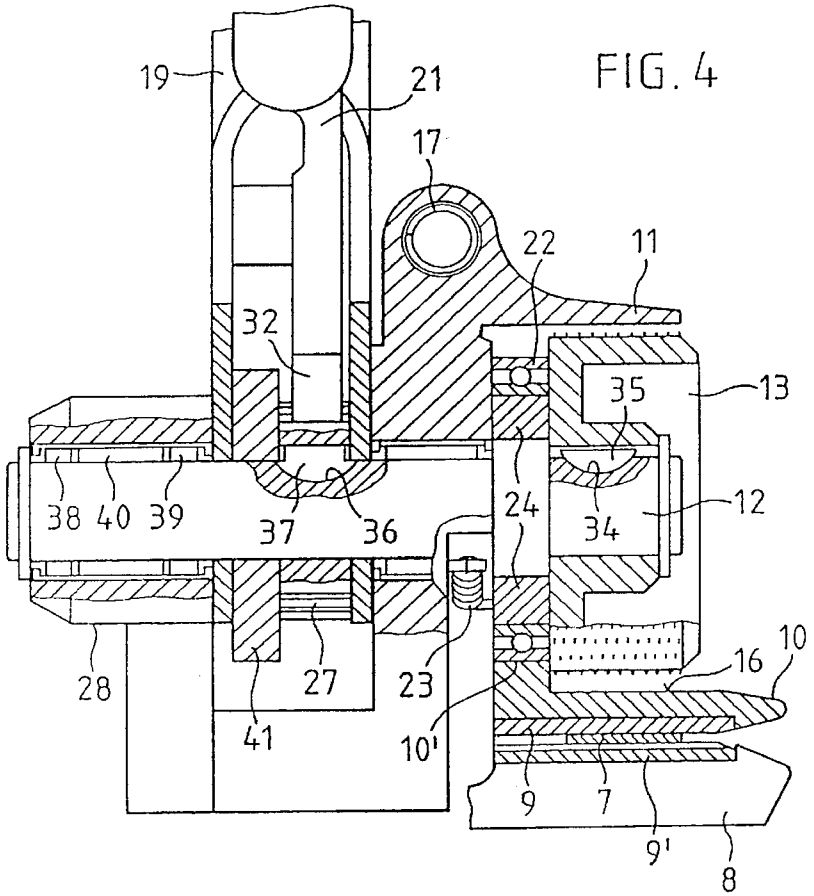
FIG. 4 shows a further section, perpendicular to the band direction, through part of the apparatus in the non-engaged position.

The rotatably arranged ring element 24, which connected to the rocker 11 via the tension spring 23, is provided between the tensioning shaft 12 and the ball bearing 22 enclosing the tensioning shaft 12 (see also FIG. 4). The ball bearing 22 is arranged loosely around the tensioning shaft 12 behind the tensioning wheel 13 opposite the supporting surface 10' of the tensioning shoe 10. The ring element 24 serves as wedge between the tensioning shaft 12 and the ball bearing 22 and, by actuating the tensioning shaft 12, can be moved from the non-engaged position (FIG. 3), in which the tensioning wheel 13 is held at a distance from the tensioning shoe 10, into a tensioning position (FIG. 5), in which the tensioning wheel 13 is pressed against the tensioning shoe 10, as is explained in the following.

In the non-engaged position, represented in FIG. 3, of the rocker 11, which is dictated by the position of the ring element 24, the upper end of the plastic band 1 to be sealed can be introduced between the tensioning wheel 13 and the tensioning shoe 10. With the aid of the tension spring 23, the ring element 24, and thus also the rocker 11, is held in its non-engaged position in spite of the force exerted on the rocker by the compression spring 17. In the same way as a wedge, the ring element 24 prevents the tensioning shaft 12 from lowering further. The rocker 11 can thus not be pushed further in the anticlockwise direction. The tensioning shaft 12 is pressed against the supporting surface 10' of the tensioning shoe 10 via the ring element 24 and the ball bearing 22. In this arrangement, the tensioning wheel 13 is held at a distance from the bearing surface 16 of the tensioning shoe 10.

By actuating the tensioning lever 19 in the direction 20 (in the non-engaged position according to FIG. 3), the tension shaft 12 is rotated in the anticlockwise direction by means of the ratchet wheel 27. The ring element 24 is mounted on the tension shaft 12 such that the friction between the tension shaft 12 and the ring element 24 is greater than the friction between the ring element 24 and ball bearing 22. In this arrangement, the difference of the two abovementioned frictions is selected such that upon rotation of the tensioning shaft 12, by actuating the tensioning lever 19, the ring element 24 is carried along by the tensioning shaft 12, counter to the force exerted by the tension spring 23. If the ring element 24 is carried along in the anticlockwise direction to such an extent that the tensioning shaft 12 is pressed downwards by the compression spring 17, then the rocker 11 is lowered into the tensioning position (FIG. 1, FIG. 5). The wedge (the ring element 24) is pushed away by actuation of the tensioning lever 19 in the anticlockwise direction. The rocker 11, with the tensioning wheel 13, can thus be lowered in a simple manner and without an additional rocking lever.

In this tensioning position, the upper end 6 of the plastic band 1 is also clamped between the tensioning wheel 13 and the tensioning shoe 10. By reciprocal movement of the tensioning lever 19 in the direction 20 and back again, the tension wheel 13 can then be carried along in a manner known per se by means of the ratchet wheel 27 which is arranged on the tension shaft 12, but is not shown in FIG. 3 (FIGS. 2, 4, 6, 7, 8, 9), with the result that it is rotated in the anticlockwise direction and tensions the plastic band 1 in the tensioning direction 14. The sealing button 21 activates the sealing unit 5 for friction welding of the ends 6, 7 of the tensioned plastic band 1, as is explained in more detail with reference to FIG. 9.

The locking detent 25 can be unlocked by actuating the sealing button 21. For this purpose, the sealing button 21 is configured such that its actuation, in a first displacement region of the tensioning lever 19 (see FIG. 9), results, via a switching lug and a displacement lever, in the actuation of the sealing unit 5 and, in a second displacement region of the tensioning lever 19 (FIGS. 3, 5, 7, 8), leads to the unlocking of the locking detent 25. This is described with reference to FIGS. 7, 8 and 9.

When the locking detent 25 is unlocked, the tensioning lever 19, starting from the tensioning position according to FIG. 5, can be moved downwards further to the right counter to the direction 20. In this arrangement, the tensioning lever 19 butts against the stop pin 33 (FIGS. 2, 8) of the rocker 11, with the result that the rocker 11 is carried along in the clockwise direction by the tensioning lever 19 being pivoted, and the tensioning wheel 13 is thus raised easily from the bearing surface 16 of the tensioning shoe 10. Consequently, the tension spring 23 pulls the ring element 24 back again into the position according to FIG. 3, where it functions as a wedge between the tensioning shaft 12 and the ball bearing 22. With this movement of the tensioning lever 19, the rocker 11 is thus moved into its non-engaged position (FIG. 3) again. The tensioning shaft 12 once again bears, (via the ring element 24 and the ball bearing 22) on the supporting surface 10' of the tensioning shoe 10.

When the tensioning lever 19 is then (starting from the non-engaged position, the locking detent 25 being unlocked) moved downwards still further to the right as far as the stop 26, then the rocker 11 is thus carried along in the clockwise direction, by means of the stop pin 33, counter to the force of the compression spring 17 to such an extent that the tensioning shaft 12, by way of the ring element 24 and the ball bearing 22, no longer subjects the supporting surface 10' to the loading. The tensioning shoe 10 and the upper toothed plate 9 have thus been rendered raisable again from the lower toothed plate 9'. The basic position (FIG. 2) is consequently reached once again, and the lower end 7 to be sealed of the plastic band 1 can be introduced between the toothed plates 9' or removed therefrom again.

FIG. 4 represents a further section through part of the apparatus in the non-engaged position. The section is carried out in the plane perpendicular to the tensioning direction 14. As in FIG. 3, the rocker 11 is located in its non-engaged position. The lower end 7 of the plastic band 1 to be tensioned is clamped between the toothed plates 9, 9'. The lower toothed plate 9' is arranged on the baseplate 8. The upper toothed plate 9 is fastened on the tensioning shoe 10 and, together, they are arranged loosely on the base plate 8 via vertical guide pins (not shown). The tensioning shaft 12 bears, via the element 24 and ball bearing 22, on the supporting surface 10' of the tensioning shoe 10. The tensioning wheel 13 is held, by the position of the ring element 24, at a distance from the bearing surface 16 of the tensioning shoe 10.

Figure 9:
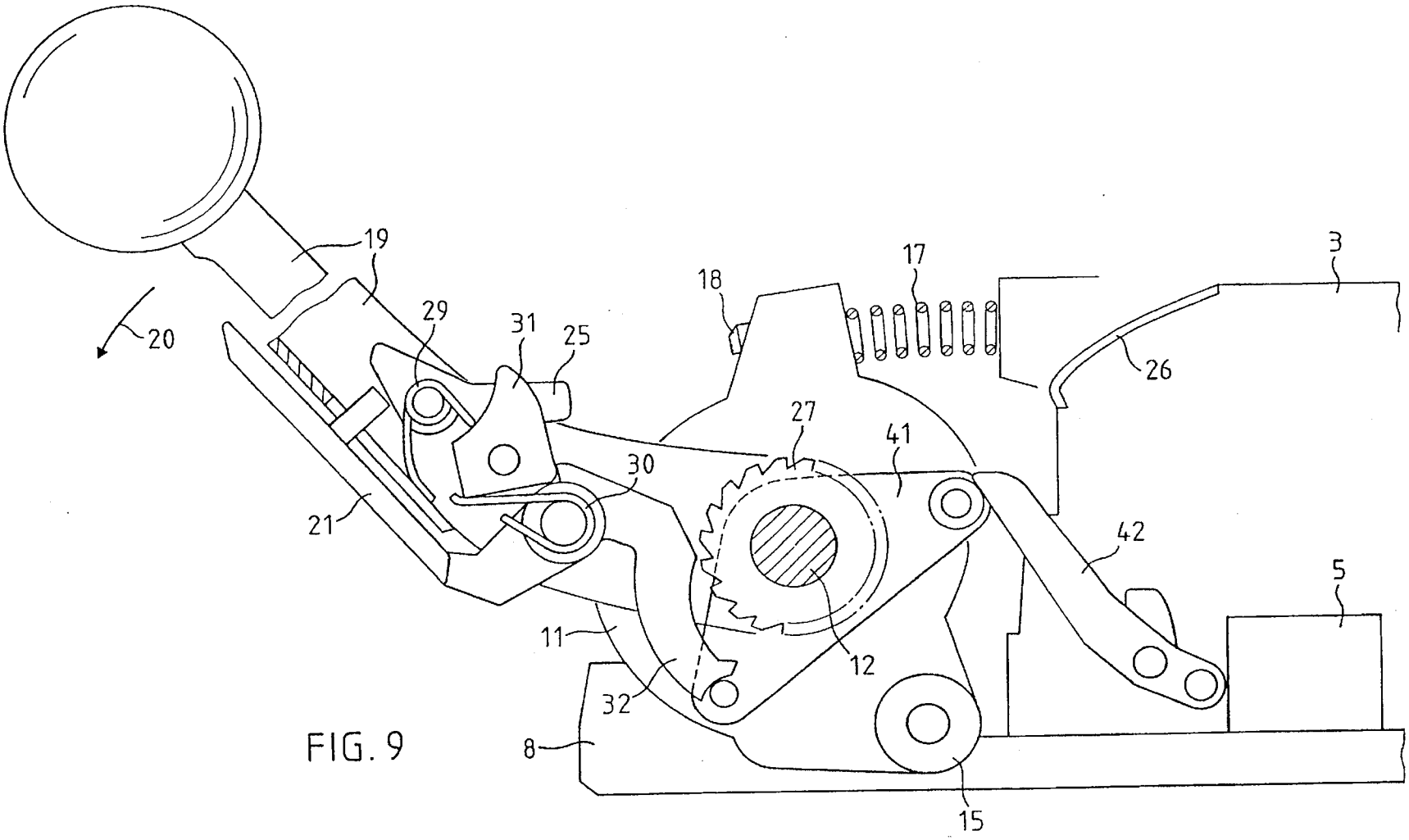
FIG. 9 shows a section through the apparatus in a welding position.

The tensioning wheel 13 is fastened in a positively locking manner on the tensioning shaft 12 by means of a Woodruff key 35 arranged in a groove 34 of the tensioning shaft 12. A frictionally locking mounting is also possible in place of this. The ball bearing 22 is arranged around the tensioning shaft 12, opposite the supporting surface 10' of the tensioning shoe 10, between the rocker 11 and the tensioning wheel 13, as seen in the direction of the tensioning shaft 12, the rotatable ring element 24 being provided between the tensioning shaft 12 and ball bearing 22. Furthermore, the compression spring 17, connected to the housing 3 and the rocker 11, the tension spring 23, connected to the spring element 24 and the rocker 11, and the tensioning lever 19 are represented schematically. The ratchet wheel 27 is fastened in a positively locking manner on the tensioning shaft 12 by means of a Woodruff key 37 arranged in a groove 36 of the tensioning shaft 12. A frictionally locking mounting is also possible in place of this. The tensioning lever 19 is mounted on the tension shaft 12 by means of a sliding bearing (not shown). The sealing button 21, projecting out of the tensioning lever 19, is connected to the tensioning detent 32 (see also FIGS. 2, 7) which engages in the ratchet wheel 27. A guide piece 28 for the tensioning shaft 12 is provided on the rocker 11. Arranged in the guide piece 28 are bearings 38, 39 for the tensioning shaft 12 as well as a back stop 40 which is formed by clamping bodies and ensures that the tensioning shaft 12 can be rotated only in the anticlockwise direction- The switching lug 41, of which the effect is described with reference to FIG. 9, is mounted on the tensioning shaft 12, beside the ratchet wheel 27, and is connected fixedly to the rocker 11.

FIG. 5 shows a section through the apparatus in the tensioning position. This position is reached, as explained above, starting from the non-engaged position according to FIG. 3, by the pivoting of the tensioning lever 19 in the direction 20 and the resulting carrying-along of the ring element 24 in the anticlockwise direction. The rocker 11 is lowered, and the tensioning wheel 13 and the tensioning shoe 10 clamp the upper end 6 of the plastic band 1 to be sealed. The ball bearing 22 is now no longer concentric with the tensioning shaft 12. The rocker 11 is no longer supported on the supporting surface 10' of the tensioning shoe 10, but bears, via the tensioning wheel 13, on the bearing surface 16 of the tensioning shoe 10. The adjustable compression spring 17 presses the rocker 11 against the tension shoe 10. The ring element 24 is rotated into its tensioning position counter to the force of the tensioning spring 23. The apparatus is ready for tensioning the plastic band 1.

Figure 6:
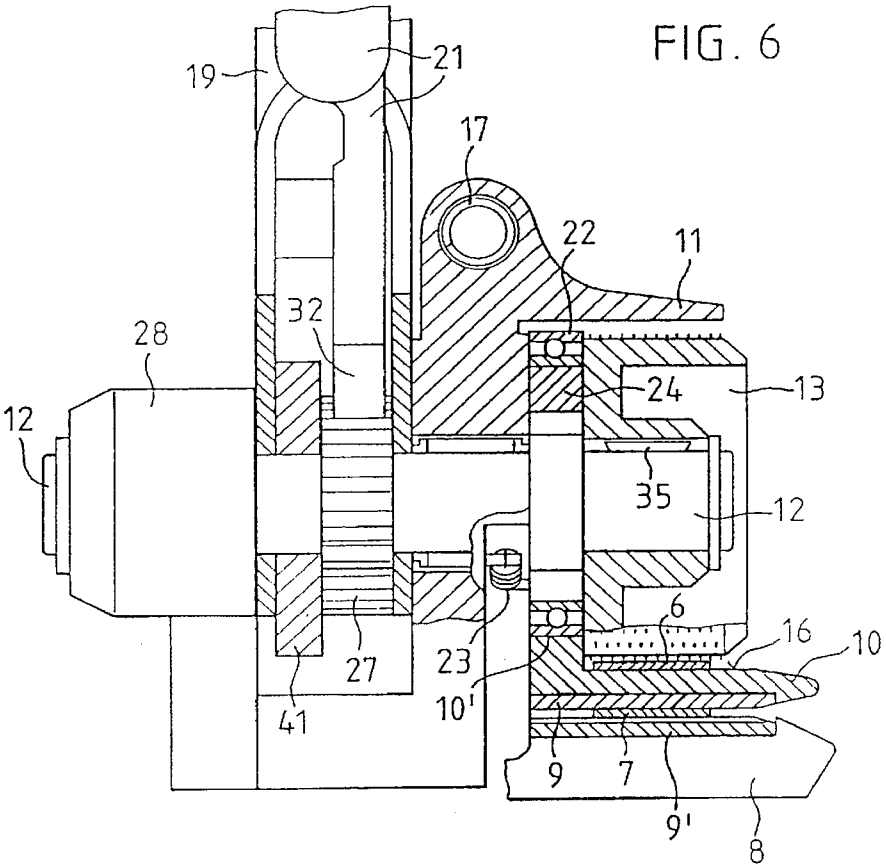
FIG. 6 shows a further section, perpendicular to the band direction, through part of the apparatus in the tensioning position.

FIG. 6 shows a further section through part of the apparatus in the tensioning position. This section is carried out in the plane perpendicular to the tensioning direction 14. As in FIG. 5, the rocker 11 is located in its tensioning position. The lower end 7 of the plastic band 1 to be sealed is clamped between the toothed plates 9, 9', and the upper end 6 of the plastic band 1 to be sealed is clamped between the tensioning wheel 13 and the tensioning shoe 10. The rocker 11 and the tensioning shaft 12 are lowered. The ring element 24 is rotated into its tensioning position counter to the force of the tension spring 23, with the result that the wedge is pushed away and the rocker bears, via the tensioning wheel 13, on the bearing surface 16 of the tensioning shoe 10.

The mounting of the individual parts on the tensioning shaft 12 is described above with reference to FIG. 4. During the tensioning process, the ratchet wheel 27 carries along the tensioning wheel 13 during reciprocal movement of the tensioning lever 19 in the direction 20 and back again (FIG. 5), with the result that it is rotated in the anticlockwise direction and tensions the plastic band 1 in the tensioning direction 14. The back stop 40 prevents the tensioning shaft 12 from being rotated back in the clockwise direction again during downwards movement of the tensioning lever 19. The plastic band 1 can be tensioned.

FIG. 7 represents a section through the apparatus according to the invention, with the sealing button 21 in first position. The rocker 11 is located in its tensioning position. The locking detent 25 is held on the tensioning lever 19 in its locking position by the compression spring 29. The sealing button 21 is held in its first position by the torsion spring 30. The further detent 31 is arranged between the sealing button 21 and the locking detent 25. The tensioning detent 32 fastened on the sealing button 21 engages in the ratchet wheel 27, with the result that the tensioning shaft 12, and thus the tensioning wheel 13, can be rotated in the tensioning direction 14.

The locking detent 25 serves for arresting the rocker 11 in the tensioning position (FIG. 5). The housing 3 exhibits a stop 26 for the locking detent 25. It restricts the displacement of the tension lever 19 and thus permits the backward movement of the rocker 11 out of its tensioning position into its non-engaged position, and thus the undesired release of the plastic band 1 during the tensioning process. The locking detent 25 thus ensures that, during the tensioning process, the full displacement of the tensioning lever 19 can be utilized without undesired release of the tensioning wheel 13.

In order to release the rocker 11 out of its tensioning position after the tensioning process, the sealing button 21 is pressed counter to the force of the compression springs 29 and 30 and is thus shifted into its second position (FIG. 8). Consequently, the locking detent 25 is brought into the position according to FIG. 8 and thus unlocked. The tension lever 19 can now be moved in the clockwise direction again to such an extent that the rocker 11 is shifted out of its tensioning position (FIG. 5) into its non-engaged position (FIG. 3). The upper band end 6 is then released. In order also to release the lower band end 7, the tensioning lever 19, with the locking detent 25 unlocked, is moved still further in the clockwise direction. By means of the stop pin 33, the rocker 11 is then carried along by the tensioning lever 19 and brought out of its non-engaged position (FIG. 3) into its basic position (FIG. 2).

As soon as the detent 31 butts against the stop 26 (see also FIGS. 2 and 8), the sealing button 21 is thus brought back into its first position (FIGS. 2, 7). Upon moving the tensioning lever 19 back from the basic position in the direction 20, the locking detent 25 resumes its locking position according to FIG. 3.

FIG. 8 shows a section through the apparatus of FIG. 7 with the sealing button in the second position. The locking detent 25 is, as described above, unlocked. The tensioning process has been ended and the tensioning detent 32 no longer engages in the ratchet wheel 27. The detent 31 ensures that the sealing button 21 is held in its second position and the locking detent 25 remains unlocked until the detent 31 butts against the stop 26.

FIG. 9 shows a section through the apparatus according to the invention in a welding position. The rocker 11 is located in its tensioning position. After the tensioning process has ended, the tensioning lever 19 is moved in the direction 20 to a far-left position. In this position, by means of the pressing of the sealing button 21, the sealing unit 5 is activated, via the tensioning detent 32, the switching lug 41 arranged on the rocker 11 and the displacement lever 42 fastened on the housing 3, for friction welding of the two band ends 6, 7. By the sealing button 21 being brought into the second position, the welding process is thus triggered in this welding position. After welding is completed, the tensioning lever 19 is moved back in the clockwise direction, with the result that the tensioning position according to FIG. 5 is reached. The plastic band 1 which is stretched around the object 2 and sealed can then be released from the apparatus by the transfer (via the non-engaged position), into the basic position.

The tensioning and sealing apparatus according to the invention functions as follows:

A plastic band 1 to be tensioned is laid around the object 2 which is to be strapped. The apparatus is brought into its basic position according to FIG. 2 and is held in this position. Once, for this purpose, the tensioning lever 19, with the locking detent 25 unlocked (FIG. 8) and the rocker 11 released (FIG. 3), has been moved to the right as far as the stop 26 (FIG. 2), the lower end 7 of the plastic band 1 is clamped between the toothed plates 9, 9'. In this arrangement, the clamping shoe 10 and the upper toothed plate 9 can be raised from the lower toothed plate 9' since the supporting surface 10'of the tensioning shoe 10 is not subjected to loading.

When the detent 31 butts against the stop 26 in the basic position, the sealing button 21, which was located in its second position according to FIG. 8 during the movement of the tensioning lever 19 to the right, is shifted back into its first position according to FIG. 7. The locking detent 25 can thus resume its locking position (FIG. 3) when the non-engaged position is subsequently reached.

After the introduction of the lower band end 7 in the basic position, the tensioning lever 19 is brought into the non-engaged position according to FIG. 3 by the force of the compression spring 17. The band end 7 is thus clamped in. In this arrangement, the locking detent 25 is brought into its locking position according to FIG. 3. The sealing button 21 remains in its first position. The rocker 11 bears, via the ring element 24 and the ball bearing 22, on the supporting surface 10' of the tensioning shoe 10 (FIG. 4).

The upper end 6 of the plastic band 1 is now introduced between the bearing surface 16 of the tensioning shoe 10 and the tensioning wheel 13. By actuating the tensioning lever 19 in the direction 20, the tensioning shaft 12 is then rotated to such an extent that the rocker 11 is lowered out of its non-engaged position (FIG. 3) into its tensioning position (FIG. 5). The upper band end 6 is thus also clamped in. The sealing button 21 remains in its first position and the locking detent 25 in its locking position.

The plastic band 1 is then tensioned in a manner known per se. For this purpose, the tensioning lever 19 is subjected to a reciprocating movement in the direction 20 and back again, with the result that, by means of the ratchet wheel 27, the tensioning shaft 12 is rotated and the tensioning wheel 13 carries along the upper band end 6 in the tensioning direction 14. The locking detent 25 ensures that, during this tensioning process, the rocker 11 is not, in an undesired manner, moved back out of its tensioning position (FIG. 5) into the non-engaged position (FIG. 3) again.

If, for any reason, the tensioning process is not carried out satisfactorily, the locking detent 25 can now be unlocked by pressing the sealing button 21. By moving the tensioning lever 19 to the right, the rocker 11 can then be readily released again and the plastic band 1 retensioned, as has been described above. This is made possible by the arrangement of the bearing 15 of the rocker 11 on the side of the tensioning shoe 10 and behind the latter, as seen in the tensioning direction 14. The plastic band does not then go to waste unnecessarily.

When the tensioning process has been carried out, the tensioning lever 19 is moved to the left (FIG. 9), and the sealing unit 5 is activated by actuating the sealing button 21, with the result that the band ends 6, 7 are welded. In this arrangement, the sealing button 21 is located in its second position, and the locking detent 25 is unlocked.

After the welding process, the rocker 11, with the locking detent 25 unlocked, is brought back, by moving the tensioning lever 19 to the right, into its non-engaged position (FIG. 3) and, further, into its basic position (FIG. 2). The tensioned and sealed band is thus released. That part of the upper band end 6 which has not been used can be separated off, and the lower band end 7 can be removed from the toothed plates 9, 9'.

The tensioning and sealing apparatus is thus once again in the basic position and ready for strapping a further object 2.

I claim:

1. An improved tensioning and sealing apparatus for strapping an object with a plastic band, which apparatus includes a base plate and a housing having a tensioning unit means for retaining two ends of the plastic band which are to be sealed and for tensioning the band in a tensioning direction and having a sealing unit means for connecting the two ends in a mutually overlapping relationship, the tensioning unit means including a tensioning shoe having a bearing surface, a pivotable rocker having a bearing and a rocker axis, a toothed tensioning wheel carried by the pivotable rocker to press the plastic band against the tensioning shoe and to grip the plastic band, and drive means for rotating the tensioning wheel, the drive means including a tensioning shaft, wherein the improvement comprises:

the bearing of the pivotable rocker is arranged on a side of the tensioning shoe and behind the tensioning shoe in the tensioning direction, the rocker axis being located between the bearing surface of the tensioning shoe and the base plate.

2. An apparatus according to claim 1, wherein the tensioning shaft has an axis, wherein the tensioning wheel has a center, wherein the bearing surface of the tensioning shoe is at least partly defined as a cylindrical depression, the bearing surface receiving the plastic band and supporting it against the tensioning wheel, wherein the cylindrical depression of the bearing surface has a center, and wherein an angle ($\alpha$), in a plane perpendicular to the tensioning-shaft axis, between a line from the tensioning-wheel center to the bearing of the rocker and a line from the tensioning-wheel center to the center of the cylindrical depression of the bearing surface ranges between 20° and 30° when the tensioning wheel presses the plastic band against the tensioning shoe.

3. An apparatus according to claim 1, wherein the tensioning unit means further comprises a spring between the pivotable rocker and the housing to produce a press-on force of the tensioning wheel against the plastic band on the tensioning shoe, the spring having a spring force, and adjustment means for adjusting the spring force to regulate the press-on force.

4. An apparatus according to claim 1, wherein the plastic band is supported on the bearing surface of the tensioning shoe, wherein the tensioning shoe also has a supporting surface, and wherein the drive means further comprises a tensioning lever, the rocker being movable by the tensioning lever from a basic position, in which the tensioning shoe is not subjected to loading, via a non-engaged position, in which the rocker is supported on the supporting surface of the tensioning shoe and the tensioning wheel is held at a distance from the bearing surface of the tensioning shoe, into a tensioning position, in which the tensioning wheel bears on the plastic band on the bearing surface of the tensioning shoe.

5. An apparatus according to claim 4, wherein the tensioning unit means further comprises a sealing button, and means for moving the rocker from the tensioning position. via the non-engaged position, back into the basic position using the tensioning lever and the sealing button.

6. An apparatus according to claim 4, wherein the tensioning unit means further comprises a ball bearing, arranged opposite the supporting surface of the tensioning shoe and loosely enclosing the tensioning shaft, a ring element between the tensioning shaft and the ball bearing, and a spring connecting the ring element to the rocker, the ring element being rotated from a first position, corresponding to the non-engaged position of the rocker, into a second position, corresponding to the tensioning position of the rocker, when the tensioning shaft is actuated.

7. An apparatus according to claim 6, further comprising means for moving the ring element from the second position into the first position again by actuating the tensioning lever.

8. An apparatus according to claim 4, wherein the tensioning unit means further comprises a locking detent to arrest the rocker in the tensioning position.

9. An apparatus according to claim 8, wherein the locking detent is arranged on the tensioning lever, and the housing comprises a stop for the locking detent.

10. An apparatus according to claim 9, wherein the tensioning unit means further comprises a sealing button, actuation of the sealing button unlocking the locking detent.

11. An apparatus according to claim 10, further comprising means for activating the sealing unit by the sealing button when the tensioning lever is in a welding position.

12. An apparatus according to claim 1, wherein one of the two mutually overlapping ends of the plastic band is a non-tensioned end, and wherein the sealing unit is arranged behind the tensioning wheel in the tensioning direction, and comprises means for friction welding of the two mutually overlapping ends of the plastic band by vibration of the non-tensioning end.

13. An apparatus according to claim 1, wherein a segment of the band passing between the tensioning wheel and the tensioning shoe has a side which faces the tensioning wheel and a side which faces the tensioning shoe, the bearing of the rocker being located on the side of the band that faces the tensioning shoe.

14. An improved tensioning and sealing apparatus for strapping an object with a plastic band, which apparatus includes a base plate and a housing having a tensioning unit means for retaining two ends of the plastic band which are to be sealed and for tensioning the band in a tensioning direction and having a sealing unit means for connecting the two ends in a mutually overlapping relationship, the tensioning unit means including a tensioning shoe having a bearing surface, a pivotable rocker having a bearing, a toothed tensioning wheel carried by the pivotable rocker to press the plastic band against the tensioning shoe and to grip the plastic band, and drive means for rotating the tensioning wheel to advance the band in the tensioning direction, the drive means including a tensioning shaft, wherein the improvement comprises:

the bearing of the pivotable rocker is located at a side of the tensioning shoe, behind the tensioning shoe in the tensioning direction, and below the bearing surface of the tensioning shoe.

15. An apparatus for tensioning a band that is looped around an object, comprising:

a pivotally mounted rocker;

a tensioning shaft rotatably mounted on the rocker;

a tensioning lever;

ratchet means for rotating the tensioning shaft in one of a clockwise direction and a counter-clockwise direction when the tensioning lever is reciprocated;

a movably mounted tensioning shoe disposed below the tensioning shaft, the tensioning shoe having a bottom side and a top side with a bearing surface and a supporting surface;

a bearing member loosely disposed around the tensioning shaft at a position above the supporting surface of the tensioning shoe;

control means for controlling the position of the bearing member with respect to the tensioning shaft, the control means being movable between a first position wherein the bearing member is constrained to be concentric with respect to the tensioning shaft and a second position wherein the bearing member is not constrained to be concentric with the tensioning shaft;

a first gripping plate mounted on the bottom side of the tensioning shoe;

a second gripping plate fixedly mounted below the first gripping plate, a first portion of the band being inserted between the gripping plates;

spring means for urging the rocker in the other of the clockwise direction and the counter-clockwise direction, the bearing member being urged against the supporting surface of the tensioning shoe to press the tensioning shoe toward the second gripping plate when the rocker is in a non-engaged position and the control means is in its first position; and a tensioning wheel mounted on the tensioning shaft, a second portion of the band being inserted between the tensioning wheel and the bearing surface of the tensioning shoe, the tensioning wheel being pressed against the second portion of the band when the rocker is in a tensioning position and the control means is in its second position.

16. An apparatus according to claim 15, wherein the gripping plates are toothed gripping plates and the tensioning wheel is a toothed tensioning wheel.

17. An apparatus according to claim 15, wherein the control means comprises a generally C-shaped member having an arcuate central recess which accommodates the tensioning shaft when the control means is in its first position.

18. An apparatus according to claim 17, wherein the control means further comprises a spring connecting the C-shaped member to the rocker.

19. An apparatus according to claim 15, wherein the bearing member comprises a ball bearing.

20. An apparatus according to claim 15, in combination with a sealing unit to join the band to itself, the sealing unit being located at a position such that the spring means urges the rocker away from the sealing means.

* * * * *